US009547265B2

(12) United States Patent
Mori

(10) Patent No.: US 9,547,265 B2
(45) Date of Patent: Jan. 17, 2017

(54) FIXING DEVICE

(71) Applicant: Brother Kogyo Kabushiki Kaisha, Nagoya-shi, Aichi-ken (JP)

(72) Inventor: Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/073,872

(22) Filed: Mar. 18, 2016

(65) Prior Publication Data

US 2016/0291513 A1 Oct. 6, 2016

(30) Foreign Application Priority Data

Mar. 31, 2015 (JP) ..... 2015-073383

(51) Int. Cl.
*G03G 15/20* (2006.01)

(52) U.S. Cl.
CPC ..... *G03G 15/2064* (2013.01)

(58) Field of Classification Search
USPC ..... 399/107, 110, 111, 122, 320, 328, 329; 219/216, 619
See application file for complete search history.

(56) References Cited

U.S. PATENT DOCUMENTS 8,737,893 B2 * 5/2014 Fujiwara ..... G03G 15/2064 399/329
8,971,778 B2 3/2015 Suzuki et al.
2006/0056887 A1 * 3/2006 Maeyama ..... G03G 15/2014 399/328
2013/0071155 A1 3/2013 Suzuki et al.

FOREIGN PATENT DOCUMENTS

JP 2013-068660 A 4/2013

* cited by examiner

*Primary Examiner* — Hoan Tran
(74) *Attorney, Agent, or Firm* — Banner & Witcoff, Ltd.

(57) ABSTRACT

A fixing device includes a heating unit including an endless belt and a heating plate, a fixing roller to form a nip portion, a frame including a first sidewall and a second sidewall, a first shaft that the fixing roller has, a second shaft disposed upstream of the nip portion, and a third shaft disposed downstream of the nip portion. One end portion of the first shaft, one end portion of the second shaft and one end portion of the third shaft are supported by the first sidewall. The other end portion of the first shaft, the other end portion of the second shaft and the other end portion of the third shaft are supported by the second sidewall. When viewed from the longitudinal direction, the nip portion is positioned in a triangle defined by imaginary lines connecting the first, second and third shafts to each other.

12 Claims, 9 Drawing Sheets

FIXING DEVICE

CROSS-REFERENCE TO RELATED APPLICATION

This application claims priority from Japanese Patent Application No. 2015-073383, filed on Mar. 31, 2015, which is incorporated herein by reference in its entirety.

TECHNICAL FIELD

The disclosure relates to a fixing device for an electrophotographic image forming apparatus.

BACKGROUND

Known fixing devices include a pressing roller and a fixing belt disposed in pressure contact with the pressing roller. In the fixing devices, the pressing roller rotates by applying a driving force to a gear attached to a shaft of the pressing roller, whereby the pressing roller rotates, and the fixing belt rotates in association with the rotation of the pressing roller.

Some of the known fixing devices may further include a frame that rotatably supports the pressing roller and slidably supports a heating unit including the fixing belt. In these fixing devices, the heating unit is pressed toward the pressing roller, whereby the fixing belt and the pressing roller form a nip point therebetween.

SUMMARY

In the known fixing devices, the frame may include sidewalls, one of which may face the gear of the pressing roller. When a driving force is applied to the gear, the sidewall facing the gear may undergo a force such that the gear-facing sidewall may become misaligned relative to the opposite sidewall, due to torque. Therefore, a pressing force applied by the heating unit to the pressing roller might not act equally on all locations along an axial direction of the pressing roller, which may exert influence on printing.

According to one or more aspects of the disclosure, a fixing device may include a heating unit, a fixing roller, a frame, a first shaft, a second shaft and a third shaft. The heating unit may include an endless belt extending in a longitudinal direction, and a heating plate disposed inside the endless belt and extending in the longitudinal direction. The fixing roller may be configured to rotate about an axis extending in the longitudinal direction and may be configured to nip the endless belt with the heating plate to form a nip portion such that a sheet is conveyed through the nip portion in a conveying direction. The frame may support the heating unit and the fixing roller and may include a first sidewall at one of end portions of the frame in the longitudinal direction and a second sidewall at the other of the end portions of the frame in the longitudinal direction. The first shaft may extend in the longitudinal direction. The fixing roller may have the first shaft. The second shaft may extend in the longitudinal direction and may be disposed upstream of the nip portion in the conveying direction and may be disposed on a heat unit side with respect to the nip portion. The third shaft may extend in the longitudinal direction and may be disposed downstream of the nip portion in the conveying direction and may be disposed on the heat unit side with respect to the nip portion. One end portion of the first shaft, one end portion of the second shaft and one end portion of the third shaft may be supported by the first sidewall. The other end portion of the first shaft, the other end portion of the second shaft and the other end portion of the third shaft may be supported by the second sidewall. When viewed from the longitudinal direction, the nip portion may be positioned in a triangle defined by imaginary lines connecting the first shaft, the second shaft, and the third shaft to each other.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

For a more complete understanding of the present disclosure, needs satisfied thereby, and the objects, features, and advantages thereof, reference now is made to the following descriptions taken in connection with the accompanying drawings. Hereinafter, illustrative embodiments of the disclosure will be described in detail with reference to the accompanying drawings. With reference to a printer 1, directions of up, down, right, left, front, and rear may be defined with reference to an orientation of the printer 1 that is disposed in which it is intended to be used as depicted in FIG. 1.

1. Overall Configuration of Printer

Figure 1:
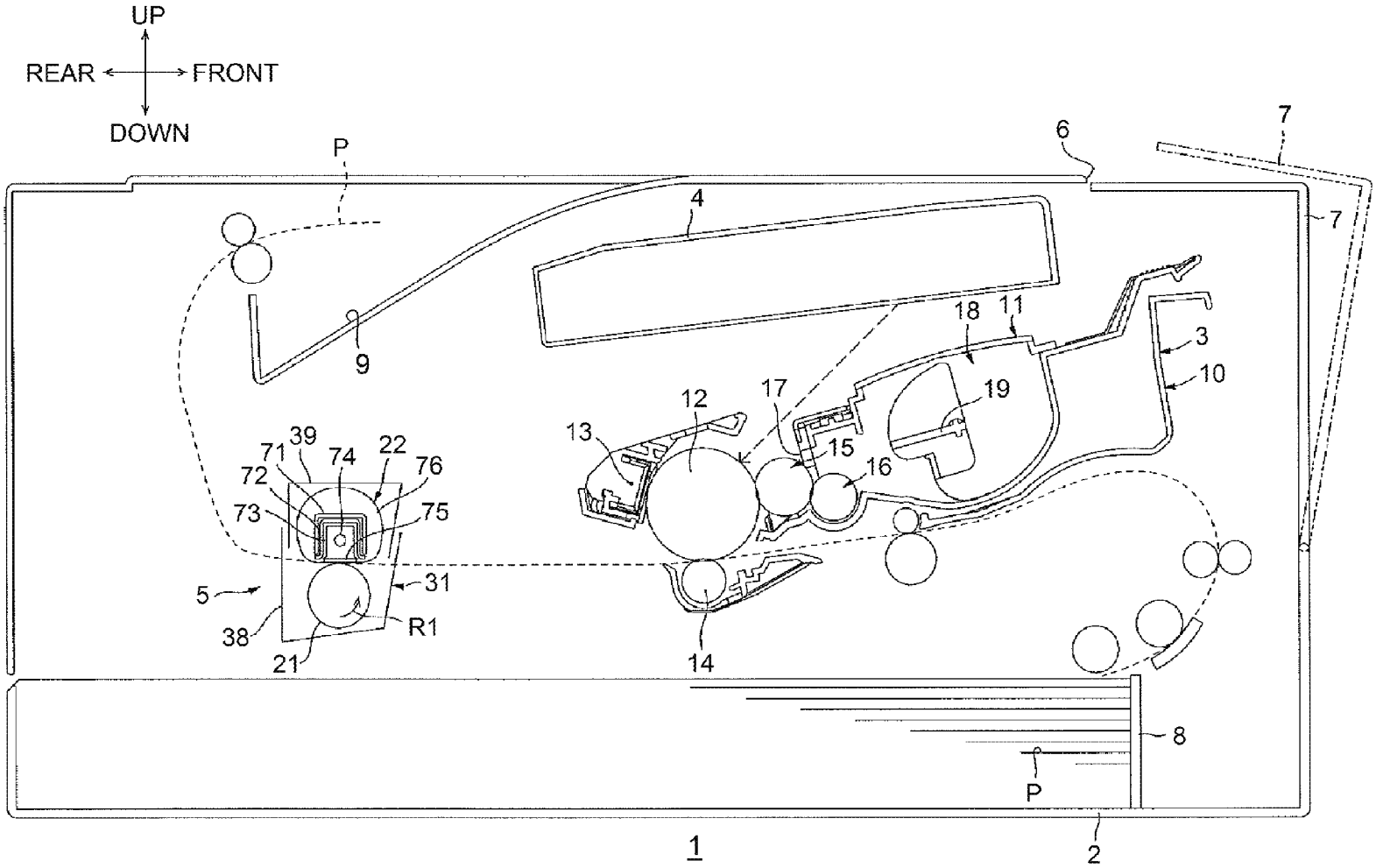
FIG. 1 is a central cross-sectional view depicting a printer including a fixing device in a first illustrative embodiment according to one or more aspects of the disclosure.

As depicted in FIG. 1, the printer 1 may be an electrophotographic monochrome printer. The printer 1 includes a body 2, a process cartridge 3, a scanner unit 4, and a fixing device 5. The body 2 has an opening 6 defined therein.

The body 2 has a substantially box shape. The body 2 includes a front cover 7, a feed tray 8, and a discharge tray 9.

The opening 6 is defined in a front end portion of the body 2. The opening 6 penetrates the body 2 in a front-rear direction to provide communication between the inside and the outside of the body 2 for allowing the process cartridge 3 to pass therethrough.

The front cover 7 is disposed at the front end portion of the body 2. The front cover 7 has a substantially L-shaped plate shape in side section. The front cover 7 is supported by a front wall of the body 2 so as to be pivotable on a lower end of the front cover 7 relative to the front wall of the body 2. The front cover 7 is configured to expose and conceal the opening 6.

The feed tray 8 is disposed at a bottom in the body 2. The feed tray 8 is configured to accommodate one or more sheets P therein.

The discharge tray 9 is disposed at an upper wall of the body 2. The discharge tray 9 is recessed downward relative to an upper surface of the body 2 for supporting one or more sheets P thereon.

The process cartridge 3 is positioned in a substantially middle portion of the body 2 in an up-down direction. The process cartridge 3 is configured to be attached to and removed from the body 2 through the opening 6. The process cartridge 3 includes a drum cartridge 10 and a developing cartridge 11.

The drum cartridge 10 includes a photosensitive drum 12, a scorotron charger 13, and a transfer roller 14.

The photosensitive drum 12 is rotatably supported by a rear end portion of the drum cartridge 10. The photosensitive drum 12 has a substantially hollow cylindrical shape extending in a right-left direction (as an example of a longitudinal direction).

The scorotron charger 13 is disposed further to the rear than the photosensitive drum 12 and is spaced from the photosensitive drum 12.

The transfer roller 14 is disposed below the photosensitive drum 12. The transfer roller 14 is in contact with a lower surface of the photosensitive drum 12.

The developing cartridge 11 is attached to the drum cartridge 10 in front of the photosensitive drum 12. The developing cartridge 11 includes a developing roller 15, a supply roller 16, a layer-thickness regulating blade 17, a toner storage 18, and an agitator 19.

The developing roller 15 is rotatably supported by a rear end portion of the developing cartridge 11. The developing roller 15 has a substantially solid cylindrical shape extending in the right-left direction. The developing roller 15 is in contact with a front surface of the photosensitive drum 12.

The supply roller 16 is disposed diagonally below and further to the front than the developing roller 15. The supply roller 16 is rotatably supported by the developing cartridge 11. The supply roller 16 has a substantially solid cylindrical shape extending in the right-left direction. The supply roller 16 is in contact with a lower front surface of the developing roller 15.

The layer-thickness regulating blade 17 is disposed diagonally above and further to the front than the developing roller 15. The layer-thickness regulating blade 17 is in contact with a front surface of the developing roller 15.

The toner storage 18 is disposed further to the front than the supply roller 16 and the layer-thickness regulating blade 17. The toner storage 18 is configured to store toner therein.

The agitator 19 is rotatably supported in the toner storage 18.

The scanner unit 4 is disposed above the process cartridge 3. The scanner unit 4 is configured to emit a laser beam based on image data toward a surface of the photosensitive drum 12.

The fixing device 5 is disposed further to the rear than the process cartridge 3. The fixing device 5 includes a heating unit 22 and a fixing roller 21.

The heating unit 22 extends in the right-left direction.

The fixing roller 21 is disposed below the heating unit 22. The fixing roller 21 has a substantially solid cylindrical shape extending in the right-left direction.

As the printer 1 starts image formation, the scorotron charger 13 charges a surface of the photosensitive drum 12 uniformly. Then, the scanner unit 4 exposes the surface of the photosensitive drum 20 based on image data. Thus, an electrostatic latent image based on the image data is formed on the surface of the photosensitive drum 12.

The agitator 19 agitates toner stored in the toner storage 18 and supplies toner onto a surface of the supply roller 16. The supply roller 16 further supplies toner onto a surface of the developing roller 15 while toner is positively charged by friction caused between the supply roller 16 and the developing roller 15. Thus, the developing roller 15 holds the charged toner. Then, the layer thickness regulating blade 17 regulates a layer thickness of toner held by the developing roller 15. Thus, toner becomes a thin layer having a certain thickness.

Thereafter, the developing roller 15 supplies toner held on its surface onto the electrostatic latent image formed on the surface of the photosensitive drum 12. Thus, the electrostatic latent image becomes a toner image. Therefore, the photosensitive drum 12 holds the toner image on its surface.

One or more sheets P are fed one by one to between the photosensitive drum 12 and the transfer roller 14 at predetermined timings from the feed tray 8 by rotation of rollers. The toner image held by the surface of the photosensitive drum 12 is transferred onto a sheet P when the sheet P passes between the photosensitive drum 12 and the transfer roller 14.

The sheet P is applied with heat and pressure while the sheet P passes between the fixing roller 21 and the heating unit 22. Thus, the toner image transferred onto the sheet P is thermally fixed thereon.

Thereafter, the sheet P having the image thereon is discharged onto the discharge tray 9.

2. Details of Fixing Device

Figure 2:
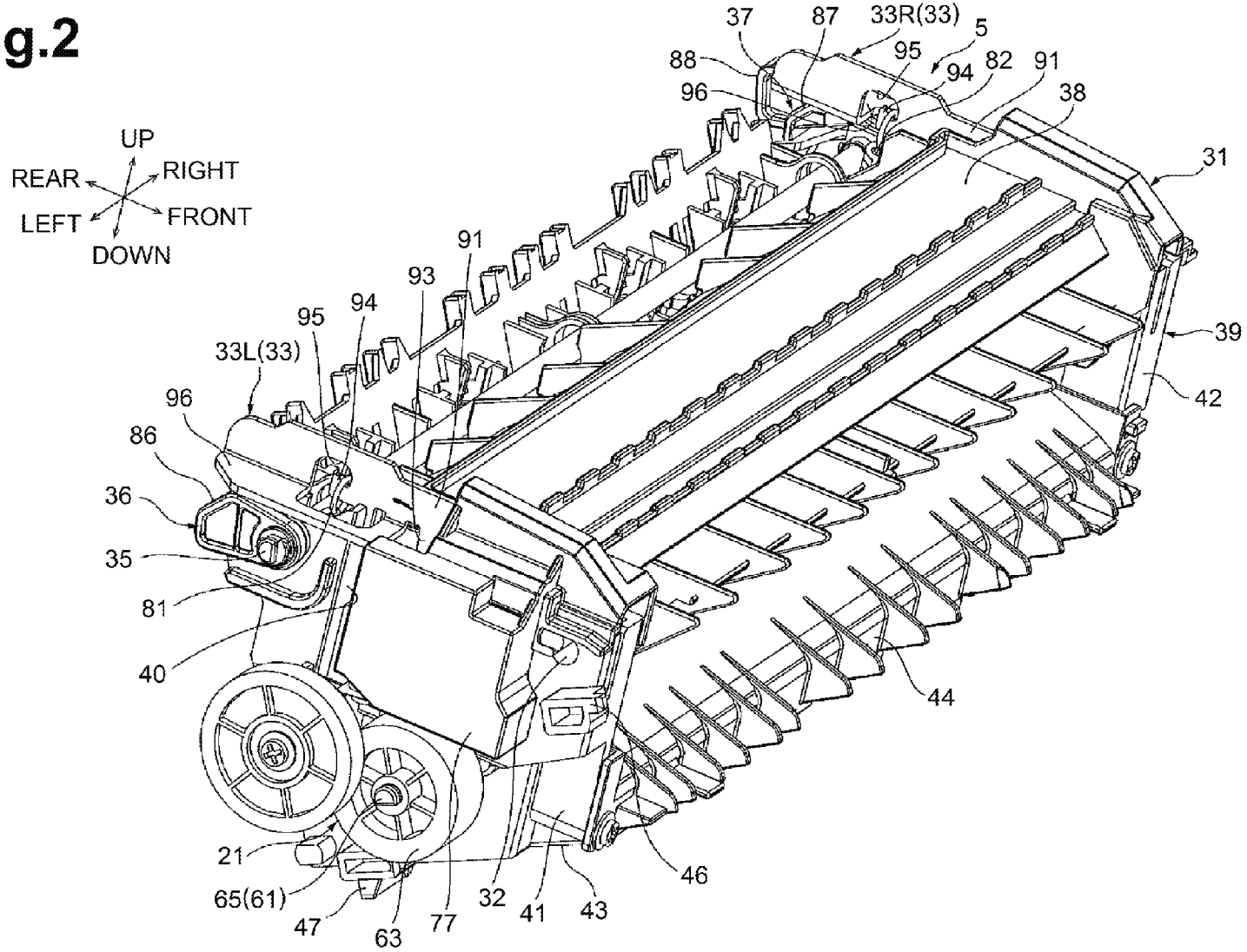
FIG. 2 is an upper left perspective view depicting the fixing device of FIG. 1 in the first illustrative embodiment according to one or more aspects of the disclosure.
Figure 3:
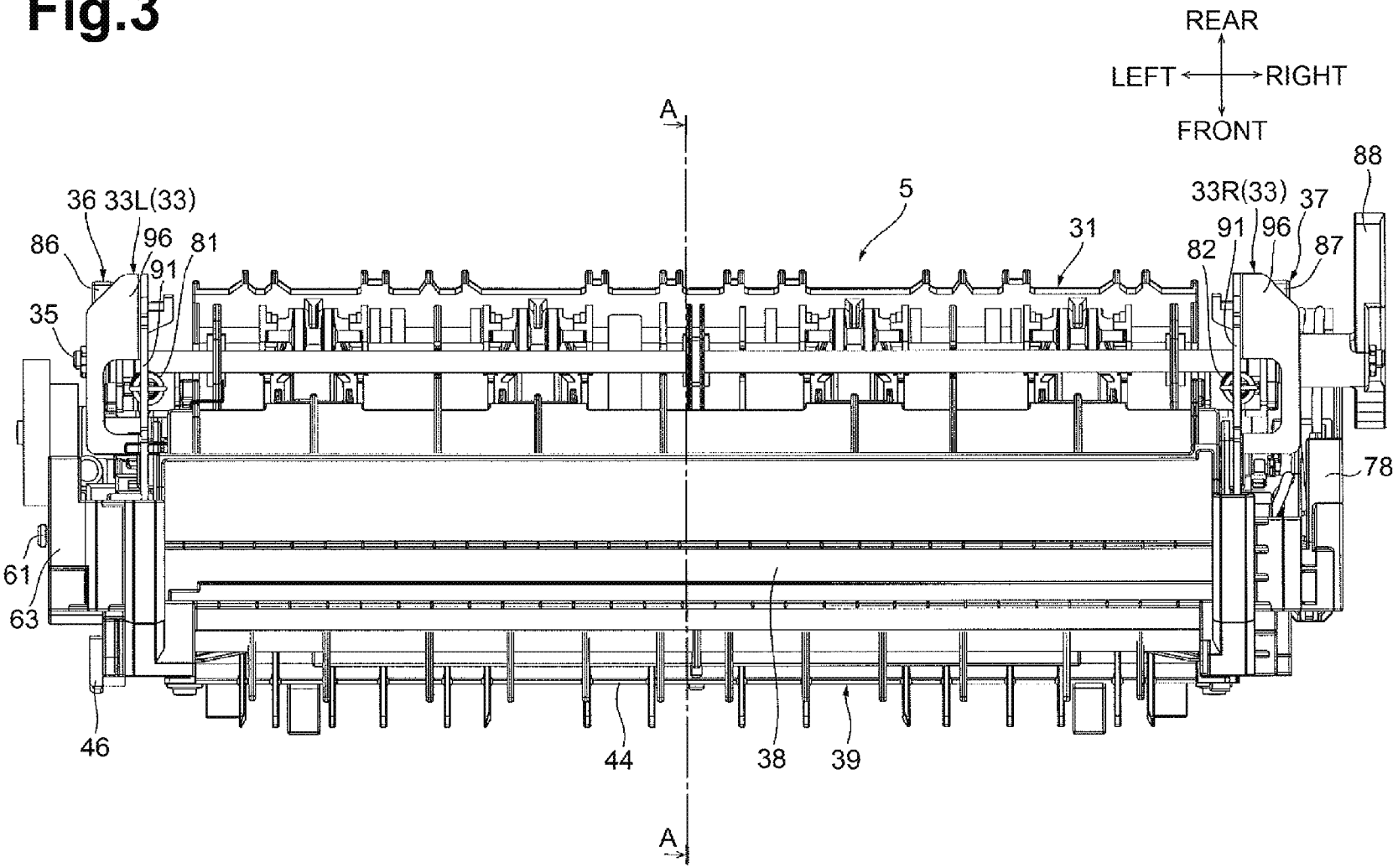
FIG. 3 is a plan view depicting the fixing device of FIG. 1 in the first illustrative embodiment according to one or more aspects of the disclosure.
Figure 6:
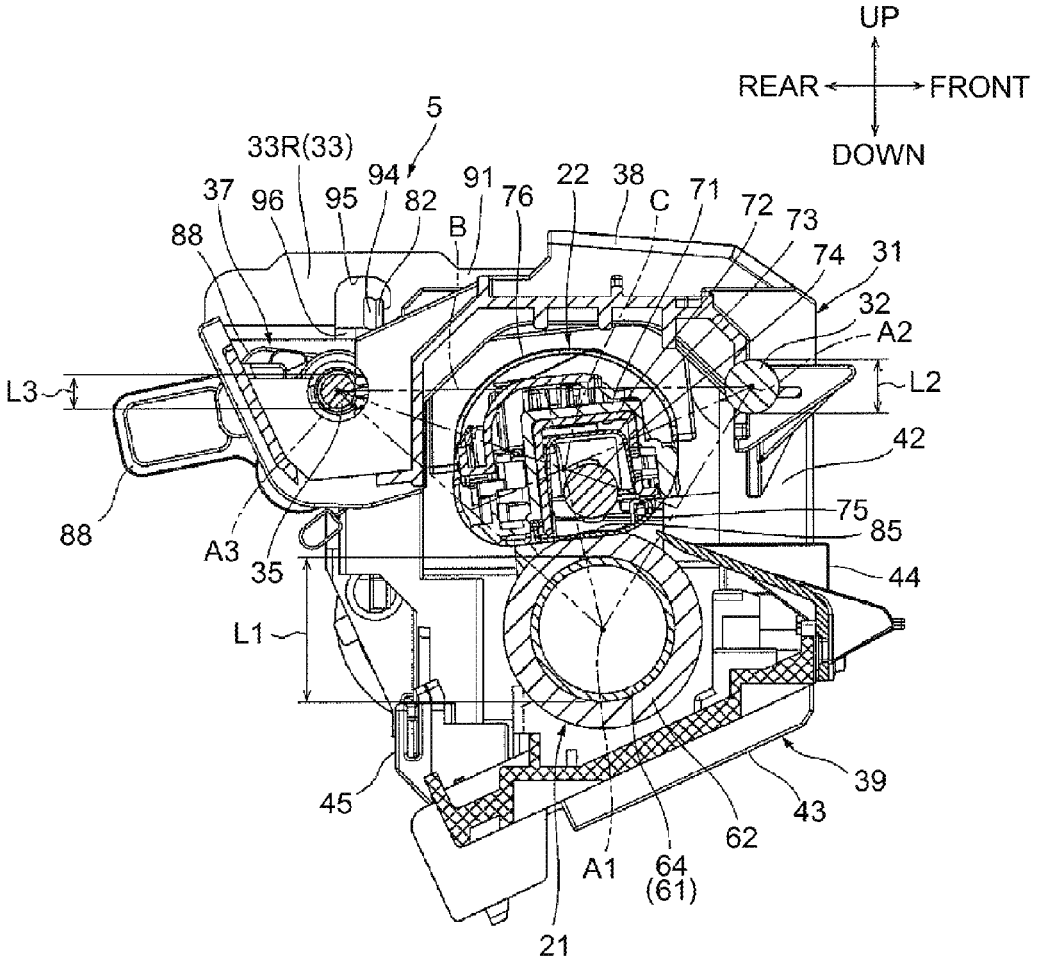
FIG. 6 is a sectional view depicting the fixing device taken along line A-A in FIG. 3 in the first illustrative embodiment according to one or more aspects of the disclosure.

As depicted in FIGS. 2 and 6, the fixing device 5 includes a frame 31, the fixing roller 21, the heating unit 22, a second shaft 32, a plurality of pressing members 33 including a first pressing member 33L and a second pressing member 33R, a third shaft 35, a first cam 36, and a second cam 37. The first pressing member 33L and the second pressing member 33R each have an cavity 95.

(1) Frame

As depicted in FIG. 2, the frame 31 may be made of resin material. The frame 31 has a substantially box shape extending in the right-left direction. The frame 31 includes a lower frame 39 and an upper frame 38.

Figure 7:
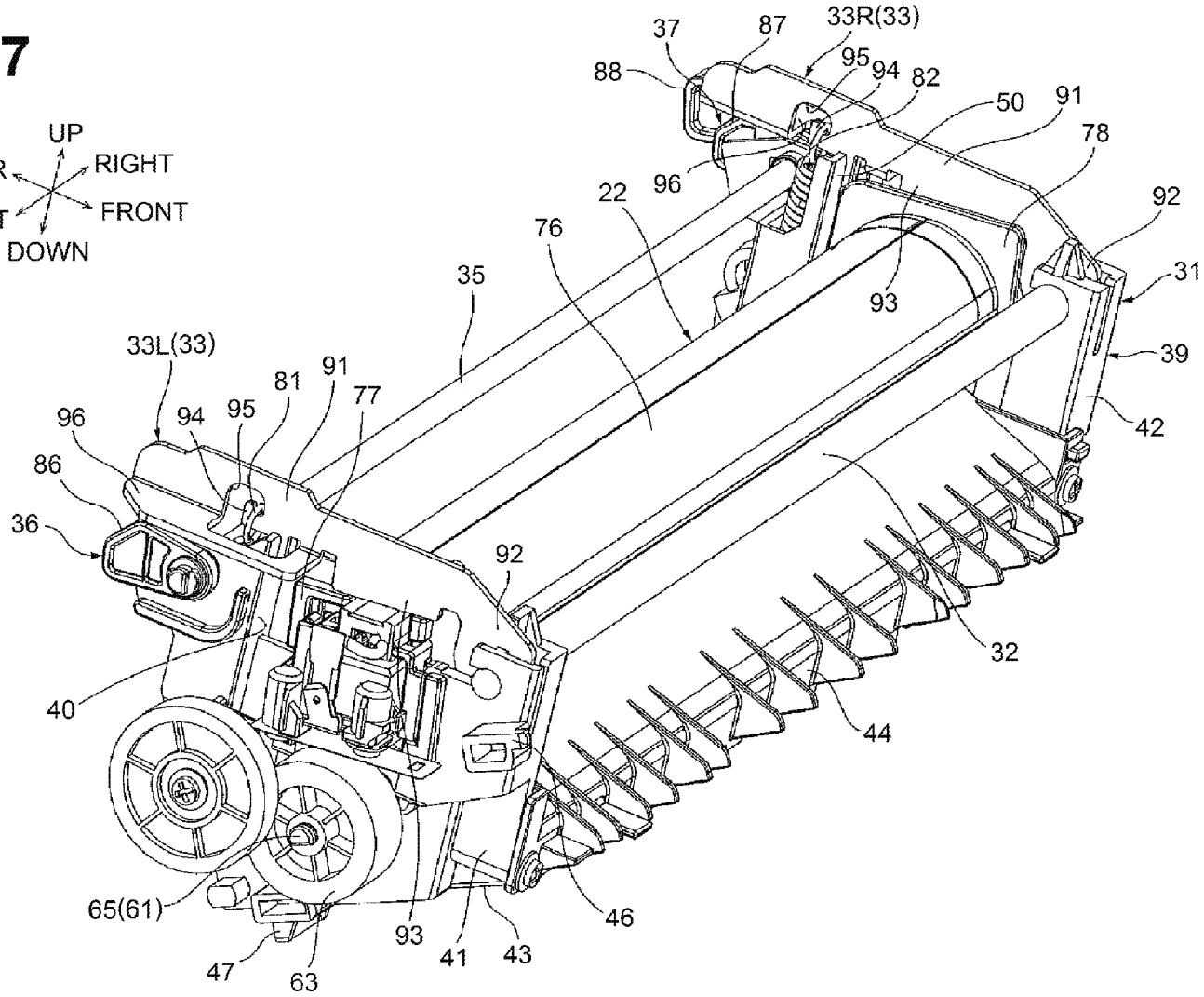
FIG. 7 is an upper left perspective view depicting the fixing device of FIG. 2 in the first illustrative embodiment according to one or more aspects of the disclosure, wherein an upper frame is removed.

The lower frame 39 constitutes a lower portion of the frame 31. As depicted in FIGS. 6 and 7, the lower frame 39 includes a first sidewall 41, a second sidewall 42, a bottom wall 43, a front wall 44, and a rear wall 45. The first sidewall 41 has a first recess 40. The second sidewall 42 has a second recess 50 (refer to FIG. 5).

Figure 4:
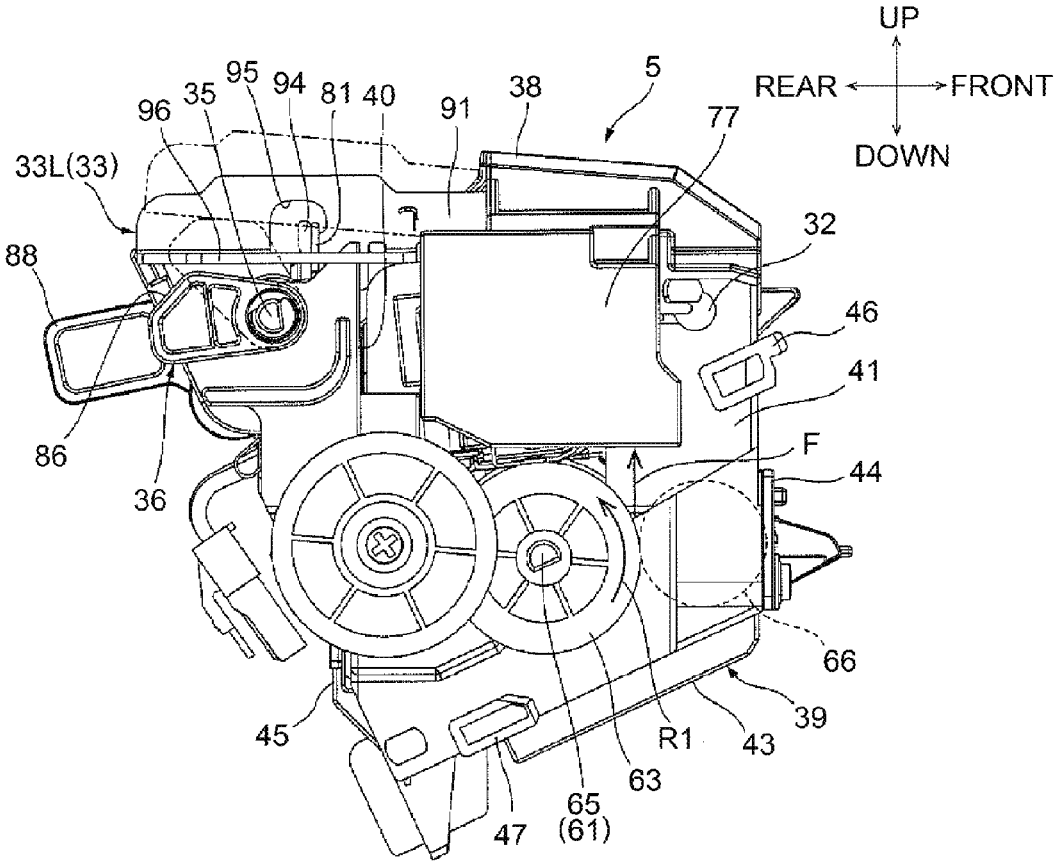
FIG. 4 is a left side view depicting the fixing device of FIG. 1 in the first illustrative embodiment according to one or more aspects of the disclosure.

As depicted in FIGS. 4 and 7, the first sidewall 41 constitutes a left end portion of the lower frame 39. The first sidewall 41 has a plate-like shape. The first sidewall 41 includes engagement portions 46 and 47.

The first recess 40 is recessed downward relative to an upper end of the first sidewall 41 from a middle portion of the first sidewall 41 in the front-rear direction. The first recess 40 has a substantially upwardly-open U shape in side view. The first recess 40 has a bottom located at a substantially middle portion of the first sidewall 41 in the up-down direction.

The engagement portion 46 is disposed at an upper front end portion of the first sidewall 41. The engagement portion 46 has a substantially rectangular tubular shape. The engagement portion 46 extends leftward from a left surface of the first sidewall 41. When viewed from the right or the left in the right-left direction, the engagement portion 46 extends diagonally upward toward the front or diagonally downward toward the rear.

The engagement portion 47 is disposed at a lower end portion of the first sidewall 41. The engagement portion 47 has a substantially rectangular tubular shape. The engagement portion 47 extends leftward from the left surface of the first sidewall 41. When viewed from the right or the left in the right-left direction, the engagement portion 47 extends diagonally upward toward the front or diagonally downward toward the rear.

Figure 5:
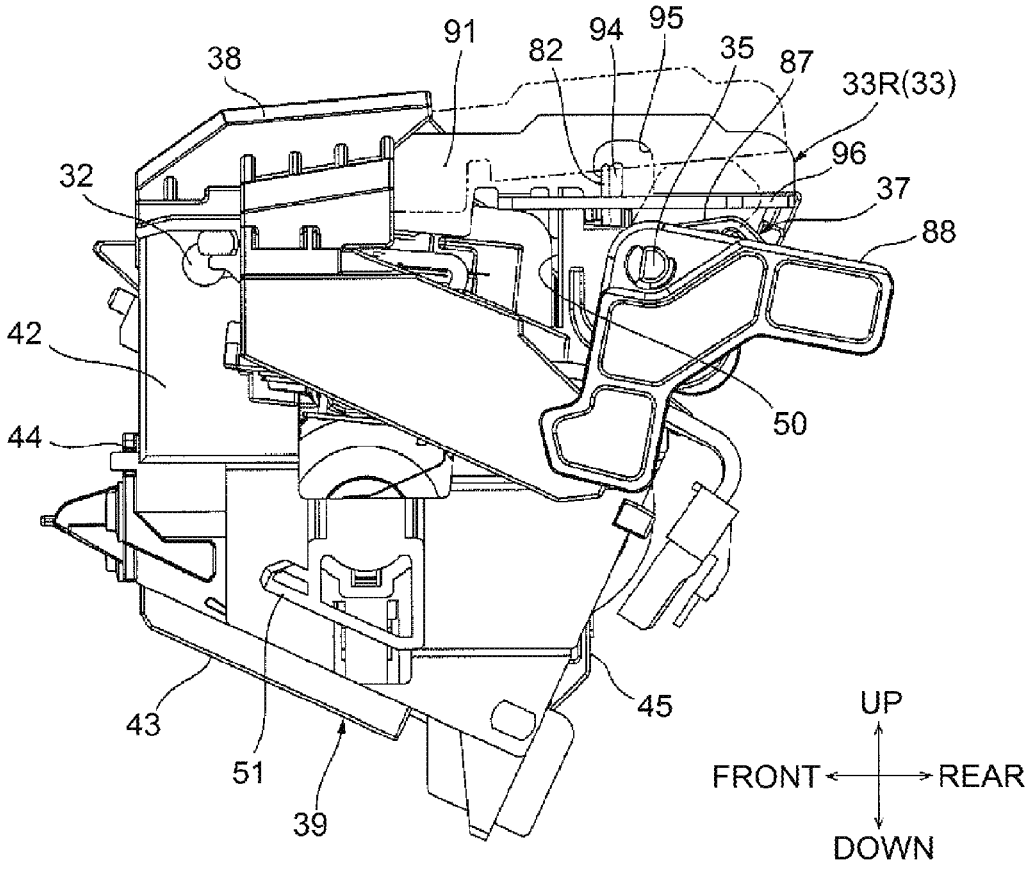
FIG. 5 is a right side view depicting the fixing device of FIG. 1 in the first illustrative embodiment according to one or more aspects of the disclosure.

As depicted in FIGS. 5 and 7, the second sidewall 42 constitutes a right end portion of the lower frame 39. The second sidewall 42 has a plate-like shape extending in the up-down direction. The second sidewall 42 includes an engagement portion 51.

The second recess 50 is recessed downward relative to an upper end of the second sidewall 42 from a middle portion of the second sidewall 42 in the front-rear direction. The second recess 50 has a substantially upwardly-open U shape in side view. The second recess 50 has a bottom located at a substantially middle portion of the first sidewall 41 in the up-down direction.

As depicted in FIG. 5, the engagement portion 51 is disposed at a lower end portion of the second sidewall 42. The engagement portion 51 has a substantially rectangular tubular shape. The engagement portion 51 extends rightward from a right surface of the second sidewall 42. When viewed from the right or the left in the right-left direction, the engagement portion 51 extends diagonally upward toward the front or diagonally downward toward the rear. When projected in the right-left direction, the engagement portion 51 is located between the engagement portion 46 and the engagement portion 47 (refer to FIG. 4).

As depicted in FIGS. 6 and 7, the bottom wall 43 connects a lower end portion of the first sidewall 41 and a lower end portion of the second sidewall 42 to each other. The bottom wall 43 has a plate-like shape.

The front wall 44 connects a lower front end portion of the first sidewall 41, a lower front end portion of the second sidewall 42, and a front end portion of the bottom wall 43 to each other. The front wall 44 has a substantially L-shape in side view. More specifically, for example, the front wall 44 extends upward from the front end portion of the bottom wall 43 and further extends diagonally upward to the rear.

The rear wall 45 connects a lower rear end portion of the first sidewall 41, a lower rear end portion of the second sidewall 42, and a rear end portion of the bottom wall 43 to each other. The rear wall 45 has a plate-like shape extending in the up-down direction.

The upper frame 38 has a substantially box shape with an open lower end. The upper frame 38 is disposed above the lower frame 39.

The frame 31 is fixedly positioned in the body 2 by engagement of the engagement portions 46 and 47 of the first sidewall 41 and the engagement portion 51 of the second sidewall 42 with their corresponding engagement portions (not depicted) of the body 2.

(2) Fixing Roller

As depicted in FIGS. 2 and 6, the fixing roller 21 includes a first shaft 61, a roller portion 62, and a fixing gear 63.

The first shaft 61 may be made of metallic material. The first shaft 61 has a substantially hollow cylindrical shape extending in the right-left direction. The first shaft 61 includes a large-diameter portion 64 and small-diameter portions 65.

As depicted in FIG. 6, the large-diameter portion 64 has a substantially hollow cylindrical shape extending in the right-left direction. The large-diameter portion 64 has a diameter L1.

As depicted in FIG. 2, one of the small-diameter portions 65 extends leftward from the center of a left surface of the large-diameter portion 64 (refer to FIG. 6). The other of the small-diameter portions 65 extends rightward from the center of a right surface of the large-diameter portion 64 (not depicted). That is, the small-diameter portions 65 extend from the respective right and left surfaces of the large-diameter portion 64 in the right-left direction. Each of the small-diameter portions 65 has a substantially solid cylindrical shape extending in the right-left direction, and has a diameter smaller than the diameter L1 of the large-diameter portion 64. The one of the small-diameter portions 65 is rotatably supported at a left end portion thereof by the lower end portion of the first sidewall 41. The other of the small-diameter portions 65 is rotatably supported at a right end portion thereof by the lower end portion of the second sidewall 42.

As depicted in FIG. 6, the roller portion 62 may be made of resin material. The roller portion 62 covers a circumferential surface of the large-diameter portion 64 of the first shaft 61. The roller portion 62 has a substantially hollow cylindrical shape extending in the right-left direction.

As depicted in FIG. 2, the fixing gear 63 has a substantially hollow cylindrical shape having a thickness in the right-left direction. The fixing gear 63 has gear teeth on its entire circumferential surface. The fixing gear 63 is attached to a left end portion of the left small-diameter portion 65 of the fixing roller 21 so as not to rotate relative to the fixing roller 21. Therefore, the fixing roller 21 is configured such that the fixing gear 63, the first shaft 61, and the roller portion 62 (refer to FIG. 6) rotate all together on an axis A1 extending in the right-left direction in FIG. 6. As depicted in FIG. 4, a front end portion of the fixing gear 63 is in mesh with a drive gear 66 disposed within the body 2.

(3) Heating Unit

As depicted in FIG. 6, the heating unit 22 is disposed above the fixing roller 21. The heating unit 22 includes a stay cover 71, a stay 72, a reflecting plate 73, a heater 74, a heating plate 75, an endless belt 76, a first engagement portion 77 (refer to FIG. 7), and a second engagement portion 78 (refer to FIG. 7).

The stay cover 71 may be made of heat-resistant resin. The stay cover 71 extends in the right-left direction. The stay cover 71 has a substantially box shape with an open lower end.

The stay 72 is disposed closer to the center of the heat unit 22 than the stay cover 71. The stay 72 may be made of metallic material. The stay 72 extends in the right-left direction. The stay 72 has a substantially rectangular tubular shape with an open lower end.

The reflecting plate 73 is disposed closer to the center of the heat unit 22 than the stay 72. The reflecting plate 73 may be made of metallic material. The reflecting plate 73 extends in the right-left direction. The reflecting plate 73 has a substantially rectangular tubular shape with an open lower end. The reflecting plate 73 has a mirror-finished inner surface.

The heater 74 is disposed closer to the center of the heat unit 22 than the reflecting plate 73. The heater 74 has a substantially solid cylindrical shape extending in the right-left direction.

The heating plate 75 is disposed below the heater 74. The heating plate 75 may be made of metallic material. The heating plate 75 has a substantially plate-like shape extending in the right-left direction. The heating plate 75 is supported by the stay 72.

The endless belt 76 may be a film having heat-resistance and flexibility. The endless belt 76 has a hollow cylindrical shape extending in the right-left direction. The endless belt 76 is looped around the stay cover 71, the stay 72, the reflecting plate 73, the heater 74, and the heating plate 75 such that (a portion of?) an inner circumferential surface of the endless belt 76 is in contact with a lower surface of the heating plate 75. A lower end portion of an outer circumferential surface of the endless belt 76 is in contact with an upper surface of the roller portion 62 of the fixing roller 21.

As depicted in FIG. 7, the first engagement portion 77 is disposed at a left end portion of the heating unit 22. The first engagement portion 77 has a substantially rectangular plate-like shape in side view. The first engagement portion 77 has substantially the same dimension in the front-rear direction as a dimension of the first recess 40 of the first sidewall 41 in the front-rear direction. The first engagement portion 77 is in engagement with the first recess 40 of the first sidewall 41. The first engagement portion 77 is supported by an edge defining the first recess 40 of the first sidewall 41 while the first engagement portion 77 is allowed to slide in the up-down direction relative to the first recess 40.

The second engagement portion 78 is disposed at a right end portion of the heating unit 22. The second engagement portion 78 has a substantially rectangular plate-like shape in side view. The second engagement portion 78 has substantially the same dimension in the front-rear direction as a dimension of the second recess 50 of the second sidewall 42 in the front-rear direction. The second engagement portion 78 is in engagement with the second recess 50 of the second sidewall 42. The second engagement portion 78 is supported by an edge defining the second recess 50 of the second sidewall 42 while second engagement portion 78 is allowed to slide in the up-down direction relative to the second recess 50.

With this configuration, the heating unit 22 is supported by the lower frame 39 while the heating unit 22 is allowed to slide in the up-down direction relative to the lower frame 39.

(4) Second Shaft, First Pressing Member, and Second Pressing Member

As depicted in FIG. 7, the second shaft 32 is disposed at an upper front end portion of the lower frame 39. The second shaft 32 may be made of metallic material. The second shaft 32 has a substantially solid cylindrical shape extending in the right-left direction. As depicted in FIG. 6, the second shaft 32 has a diameter L2, which is smaller than the diameter L1 of the large-diameter portion 64 of the fixing roller 21. A left end portion of the second shaft 32 is supported by an upper front end portion of the first sidewall 41. A right end portion of the second shaft 32 is supported by an upper front end portion of the second sidewall 42.

As depicted in FIG. 7, the first pressing member 33L is disposed above the left end portion of the second shaft 32. The first pressing member 33L is disposed above the first engagement portion 77. The first pressing member 33L may be made of metallic material. The first pressing member 33L includes an elongated portion 91, a supported portion 92, a pressing portion 93, an engagement portion 94, and a rest portion 96. The first pressing member 33L has a cavity 95.

The elongated portion 91 has a plate-like shape extending in the front-rear direction.

The supported portion 92 extends downward from an front end of the elongated portion 91. The supported portion 92 has a plate-like shape.

The pressing portion 93 extends downward from a substantially middle portion of the elongated portion 91 in the right-left direction. The pressing portion 93 has a plate-like shape extending in the front-rear direction. The pressing portion 93 is in engagement with an upper end of the first engagement portion 77 of the heating unit 22.

The cavity 95 is defined in an rear end portion of the elongated portion 91. The cavity 95 extends upward from a lower end of the elongated portion 91.

The engagement portion 94 is disposed at the rear end portion of the elongated portion 91. The engagement portion 94 extends rearward from a front edge of the cavity 95 defined in the elongated portion 91.

The rest portion 96 extends leftward in the right-left direction from the rear end portion of the elongated portion 91. The rest portion 96 has a plate-like shape extending in the front-rear direction.

The supported portion 92 of the first pressing member 33L is pivotably supported by the left end portion of the second shaft 32. Therefore, the first pressing member 33L is pivotable on an axis A2 (depicted in FIG. 6) extending in the right-left direction. As depicted in FIG. 7, the engagement portion 94 of the first pressing member 33L is in engagement with one of ends of a first urging member 81.

The first urging member 81 may be an extension coil spring. The other of the ends of the first urging member 81 is in engagement with the lower rear end portion of the first sidewall 41. With this configuration, at all times, the first pressing member 33L is under a downward urging force and the pressing portion 93 presses the first engagement portion 77 downward.

The second pressing member 33R is disposed above the right end portion of the second shaft 32 and the second engagement portion 78. The second pressing member 33R has the same or similar configuration to the first pressing member 33L. The front end portion of each of the second pressing member 33R and the first pressing member 33L is an example of a first end portion. The rear end portion of each of the second pressing member 33R and the first pressing member 33L is an example of a second end portion.

The engagement portion 94 of the second pressing member 33R is in engagement with one of ends of a second urging member 82. The second urging member 82 may be an extension coil spring. The other of the ends of the second urging member 82 is in engagement with the lower rear end portion of the second sidewall 42. With this configuration, at all times, the second pressing member 33R is under a downward urging force and the pressing portion 93 presses the first engagement portion 77 downward.

That is, the first pressing member 33L and the second pressing member 33R press the heating unit 22 downward at all times, and the heating unit 22 presses the fixing roller 21 downward at all times. Therefore, as depicted in FIG. 6, a nip point 85 is formed between the lower surface of the endless belt 76 and the upper surface of the roller portion 62 of the fixing roller 21.

(5) Third Shaft, First Cam, and Second Cam

As depicted in FIG. 7, the third shaft 35 is disposed at an upper rear end portion of the lower frame 39. The third shaft 35 may be made of metallic material. The third shaft 35 has a substantially solid cylindrical shape extending in the right-left direction. As depicted in FIG. 6, the third shaft 35 has a diameter L3, which is smaller than the diameter L2 of the second shaft 32. The third shaft 35 is rotatably supported at a left end portion thereof by an upper rear end portion of the first sidewall 41. The third shaft 35 is rotatably supported at a right end portion thereof by an upper rear end portion of the second sidewall 42. With this configuration, the third shaft 35 is rotatable on an axis A3 (refer to FIG. 6) extending in the right-left direction.

As depicted in FIG. 7, the first cam 36 is disposed at the left end portion of the third shaft 35. The first cam 36 has a substantially rectangular plate-like shape in side view and extends in the front-rear direction. The first cam 36 is attached to the left end portion of the third shaft 35 via a front end portion of the first cam 36 so as not to rotate relative to the third shaft 35. The first cam 36 includes a first pressing surface 86.

As depicted in FIG. 4, the first pressing surface 86 may be a portion of a circumferential surface of the first cam 36. When viewed from the right or the left in the right-left direction, the first pressing surface 86 extends diagonally upward toward the front or diagonally downward toward the rear.

As depicted in FIG. 7, the second cam 37 is disposed at the right end portion of the third shaft 35. The second cam 37 has a substantially rectangular plate-like shape in side view and extends in the front-rear direction. The second cam 37 is attached to the right end portion of the third shaft 35 via a front end portion of the second cam 37 so as not to rotate relative to the third shaft 35. The second cam 37 includes a second pressing surface 87.

As depicted in FIG. 5, the second pressing surface 87 may be a portion of a circumferential surface of the second cam 37. When viewed from the right or the left in the right-left direction, the second pressing surface 87 extends diagonally upward toward the front or diagonally downward toward the rear.

A handle 88 is disposed to the right of the second cam 37.

The handle 88 has a substantially L-shaped plate shape in side view. The handle 88 is attached to the right end portion of the third shaft 35 via a middle portion of the handle 88 so as not to rotate relative to the third shaft 35. The handle 88 and the second cam 37 have a one-piece body.

3. Placement of First Shaft, Second Shaft, Third Shaft, and Engagement Portions As depicted in FIG. 6, the first shaft 61 is disposed at a lower end portion in the fixing device 5. The second shaft 32 is disposed at a front end portion in the fixing device 5. The third shaft 35 is disposed at a rear end portion in the fixing device 5.

That is, when viewed from the front or the rear in the front-rear direction, the second shaft 32 is disposed opposite to the first shaft 61 relative to the nip point 85. When viewed from the front or the rear in the front-rear direction, the third shaft 35 is disposed opposite to the first shaft 61 relative to the nip point 85. When viewed from above or below in the up-down direction, the third shaft 35 is disposed opposite to the second shaft 32 relative to the nip point 85.

When viewed from the right or the left in the right-left direction, the nip point 85 and the stay 72 are included in an imaginary area B defined by an imaginary line (indicated by a double-dotted-and-dashed line) connecting the first shaft 61, the second shaft 32, and the third shaft 35 to each other. More specifically, for example, the imaginary area B may be a triangular imaginary area defined by an imaginary line connecting the centers of the axis A1, the axis A2, and the axis A3 to each other when viewed from the right or the left in the right-left direction. The center of gravity C of the imaginary area B overlaps the heating unit 22 when viewed from the right or the left in the right-left direction. More specifically, for example, the center of gravity C of the imaginary area B is located between the reflecting plate 73 and the heater 74 when viewed from the right or the left in the right-left direction the right-left direction.

As depicted in FIG. 4, the second shaft 32 is disposed diagonally above and further to the rear than the engagement portion 46. The first shaft 61 is disposed diagonally above and further to the front than the engagement portion 47 while the first shaft 61 is disposed diagonally above and further to the rear than the engagement portion 51 (refer to FIG. 5).

When viewed from the right or the left in the right-left direction, the fixing gear 63 is disposed between the engagement portion 46 and the engagement portion 47. That is, when viewed from the right or the left in the right-left direction, the fixing gear 63 and the drive gear 66 are in mesh with each other at the location between the engagement portion 46 and the engagement portion 47.

4. Behavior of Cams and Pressing Members

At the time of performing image formation in the printer 1, as depicted in FIGS. 4 and 5, the first cam 36 and the second cam 37 are located separately from the first pressing member 33L and the second pressing member 33R, respectively, as indicated by a solid line.

The positions of the first cam 36 and the second cam 37 in the above state may refer to non-pressing positions of the first cam 36 and the second cam 37.

As described above, the heating unit 22 is pressed toward the fixing roller 21 by the pressing portions 93 of the first pressing member 33L (refer to FIG. 7) and the second pressing member 33R (refer to FIG. 7).

In order to terminate the pressing of the fixing roller 21 by the heating unit 22, an operator raises the handle 88.

As the handle 88 moves upward, the third shaft 35 rotates clockwise in left side view on the axis A3 (refer to FIG. 6) together with the first cam 36 and the second cam 37.

Then, the first pressing surface 86 of the first cam 36 comes into engagement with the rest portion 96 of the first pressing member 33L to press the first pressing member 33L upward against the urging force of the first urging member 81. The second pressing surface 87 of the second cam 37 comes into engagement with the rest portion 96 of the second pressing member 33R to press the second pressing member 33R upward against the urging force of the second urging member 82.

Therefore, the first pressing member 33L rotates clockwise in left side view on the axis A2 (refer to FIG. 6) and comes separate from the first engagement portion 77. At the same time, the second pressing member 33R rotates counterclockwise in right side view on the axis A2 (refer to FIG. 6) and comes separate from the second engagement portion 78 of the second pressing member 33R.

Accordingly, the fixing roller 21 becomes free from pressure applied by the heating unit 22.

As indicated by the imaginary line in FIG. 4, the position of the first cam 36 at which the first pressing surface 86 of the first cam 36 is engagement with the rest portion 96 of the first pressing member 33L may refer to a pressing position of the first cam 36. Similar to this, as indicated by the imaginary line in FIG. 5, the position of the first cam 36 at which the second pressing surface 87 of the second cam 37 is in engagement with the rest portion 96 of the second pressing member 33R may refer to a pressing position of the second cam 37.

5. Behavior of Fixing Device

As depicted in FIG. 1, as the image formation starts, in the fixing device 5, the heating plate 75 is heated to high temperature by the heater 74. Then, as depicted in FIG. 4, a driving force is applied to the fixing gear 63 from the drive gear 66, whereby the fixing gear 63 rotates in a rotating direction R1 (e.g., a counterclockwise direction in left side view).

As depicted in FIG. 1, the endless belt 76 rotates following rotation of the fixing roller 21. Thus, a sheet P enters between the fixing roller 21 and the heating unit 22.

At that time, as depicted in FIG. 4, the fixing gear 63 receives an upward force due to torque of the drive gear 66, whereby an upward force is applied to the first shaft 61, and an upward force F is further applied to the frame 31 from the first shaft 61. More specifically, for example, the upward force F is applied to the first sidewall 41.

The first sidewall 41 is positioned relative to the body 2 by engagement of the engagement portions 46 and 47 with the body 2. Therefore, in this state, the engagement portions 46 and 47 may surely receive the torque.

The first shaft 61, the second shaft 32, and the third shaft 35 are supported by the first sidewall 41 and the second sidewall 42. Therefore, the frame 31 is reinforced with the first shaft 61, the second shaft 32, and the third shaft 35, whereby deformation or warp in the frame 31 may be reduced.

The second shaft 32 supports the first pressing member 33L and the second pressing member 33R. That is, the second shaft 32, the first pressing member 33L, and the second pressing member 33R constitute a substantially C-shaped unit with an open rear end. The C-shaped unit applies a downward force, i.e., a force that acts in a direction opposite to the force F applied from the first shaft 61, toward the heating unit 22.

Therefore, the second shaft 32, the first pressing member 33L, and the second pressing member 33R may receive the force F applied from the first shaft 61.

6. Effects (1) According to the fixing device 5 of the first illustrative embodiment, as depicted in FIG. 2, the first shaft 61, the second shaft 32, and the third shaft 35 are supported by the frame 31.

Therefore, when the upward force F is applied to the frame 31 by the first shaft 61 to which an upward force is applied due to application of a driving force to the fixing gear 63, the first shaft 61, the second shaft 32, and the third shaft 35 extending in the right-left direction may act as reinforcements for the frame 31.

As depicted in FIG. 6, when viewed from the right or the left in the right-left direction, the nip point 85 is included in the imaginary area B defined by the imaginary line connecting the centers of the first shaft 61, the second shaft 32, and the third shaft 35 to each other.

That is, when viewed from the right or the left in the right-left direction, the nip point 85 overlaps the reinforced portions of the first sidewall 41 and the second sidewall 42 with the first shaft 61, the second shaft 32, and the third shaft 35.

With this configuration, the heating unit 22 and the fixing roller 21 may be supported at the less deformable portions of the first sidewall 41 and the second sidewall 42.

Consequently, a pressing force applied by the heating unit 22 to the fixing roller 21 may be maintained equal at any locations along the right-left direction.

(2) According to the fixing device 5 of the first illustrative embodiment, as depicted in FIG. 2, the first shaft 61, the second shaft 32, and the third shaft 35 are supported by the first sidewall 41 and the second sidewall 42.

Therefore, the frame 31 may be reinforced with the first shaft 61, the second shaft 32, and the third shaft 35 along the right-left direction.

Accordingly, this configuration may reduce deformation or warp in the frame 31 on the whole.

(3) According to the fixing device 5 of the first illustrative embodiment, as depicted in FIG. 6, the stay 72 is included in the imaginary area B when viewed from the right or the left in the right-left direction.

Therefore, the frame 31 may be further reinforced with the stay 72.

(4) According to the fixing device 5 of the first illustrative embodiment, as depicted in FIG. 7, the second shaft 32 serves as the rotating shaft of the first pressing member 33L and the second pressing member 33R.

Therefore, a parts count for the fixing device 5 may be reduced.

The second shaft 32 connects between the first pressing member 33L and the second pressing member 33R.

Therefore, the frame 31 may be reinforced with all of the second shaft 32, the first pressing member 33L, and the second pressing member 33R.

Accordingly, the frame 31 may be surely reinforced.

The second shaft 32, the first pressing member 33L, and the second pressing member 33R constitute the substantially C-shaped unit with an open rear end. The C-shaped unit applies a downward force, i.e., a force that acts in a direction opposite to the force F applied from the first shaft 61, toward the heating unit 22.

Therefore, the second shaft 32, the first pressing member 33L, and the second pressing member 33R may receive the force F applied from the first shaft 61.

(5) According to the fixing device 5 of the first illustrative embodiment, as depicted in FIG. 7, the third shaft 35 serves as the rotating shaft of the first cam 36 and the second cam 37.

Therefore, the parts count for the fixing device 5 may be further reduced.

The third shaft 35 connects between the first pressing member 33L and the second pressing member 33R.

Therefore, the frame 31 may be reinforced with all of the third shaft 35, the first pressing member 33L, and the second pressing member 33R.

(6) According to the fixing device 5 of the first illustrative embodiment, as depicted in FIG. 6, the diameter L1 of the first shaft 61 is greater than the diameter L2 of the second shaft 32 and the diameter L3 of the third shaft 35.

Therefore, the first shaft 61 of the fixing roller 21 may have a higher rigidity.

Accordingly, the frame 31 may be further reinforced.

(7) According to the fixing device 5 of the first illustrative embodiment, as depicted in FIG. 6, the center of gravity C of the imaginary area B overlaps the heating unit 22 when viewed from the right or the left in the right-left direction.

Therefore, a pressing force applied by the heating unit 22 to the fixing roller 21 may be maintained further equal at any locations along the right-left direction.

(8) According to the fixing device 5 of the first illustrative embodiment, as depicted in FIG. 2, the frame 31 may be made of resin material, and the first shaft 61, the second shaft 32, and the third shaft 35 may be made of metallic material.

Therefore, the first shaft 61, the second shaft 32, and the third shaft 35 may have a higher rigidity.

Accordingly, the frame 31 may be surely reinforced with the first shaft 61, the second shaft 32, and the third shaft 35.

7. Second Illustrative Embodiment

Figure 8:
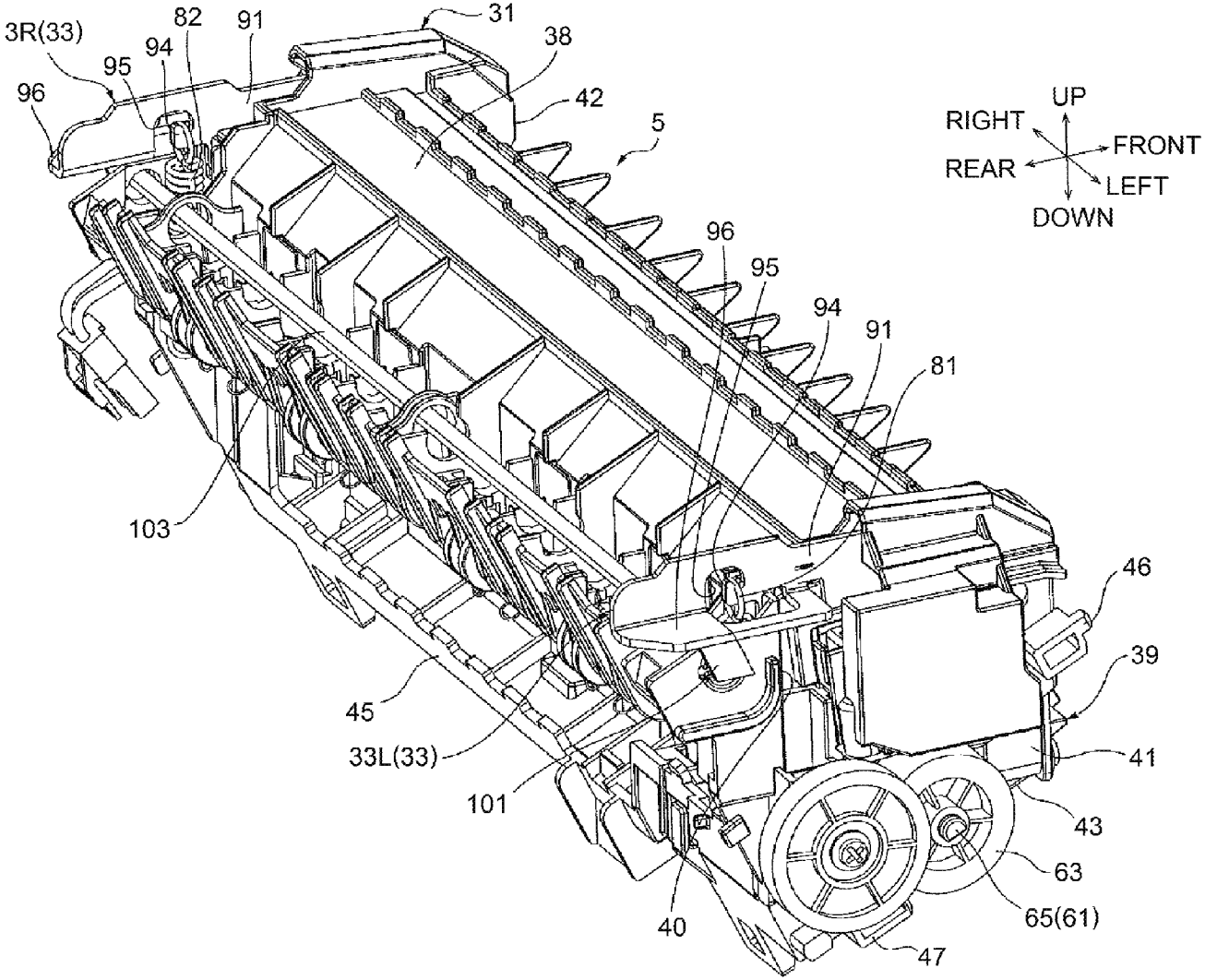
FIG. 8 is an upper left perspective view depicting a fixing device in a second illustrative embodiment according to one or more aspects of the disclosure.
Figure 9:
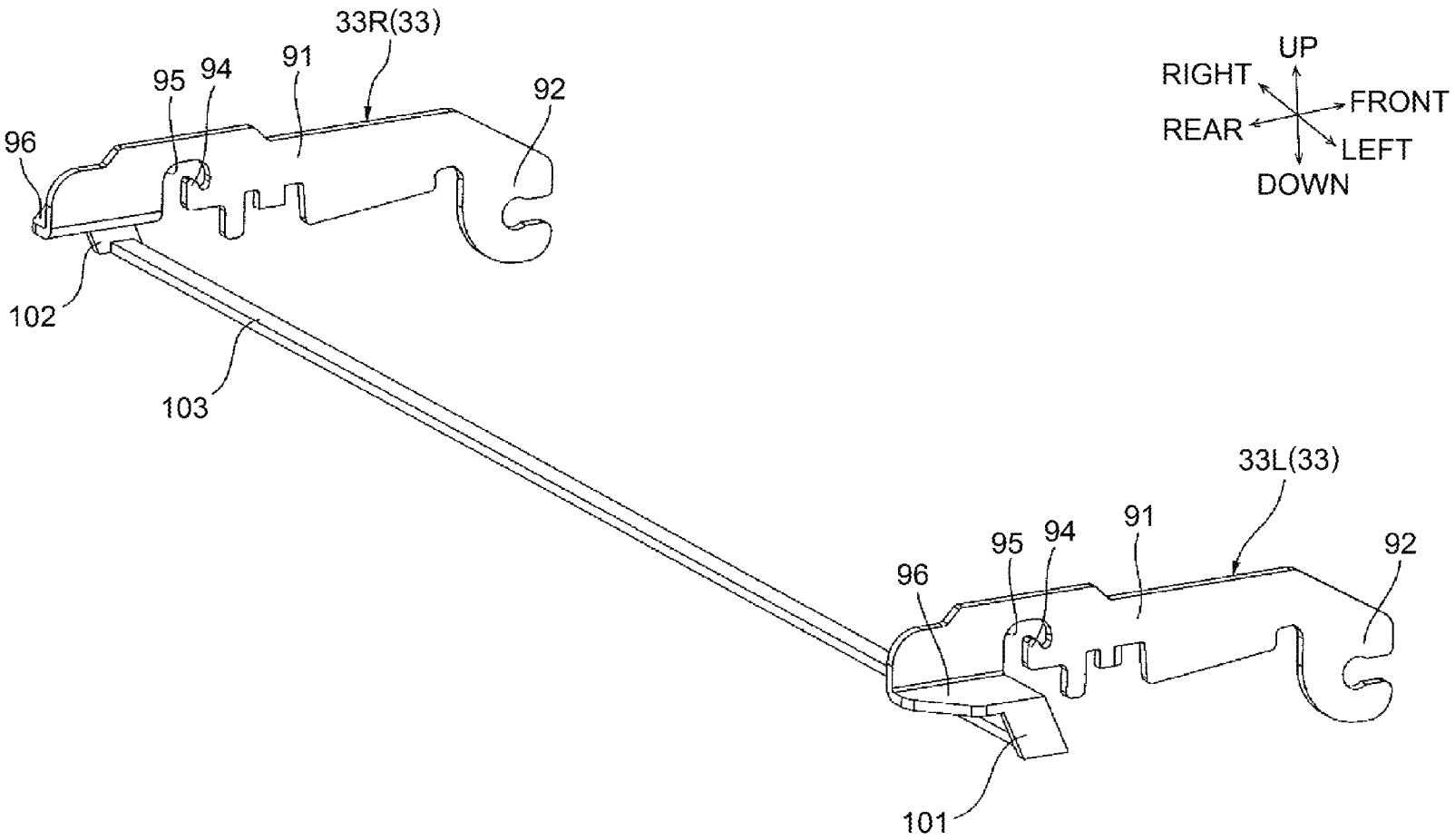
FIG. 9 is an upper left perspective view depicting pressing members of FIG. 8 in the second illustrative embodiment according to one or more aspects of the disclosure.

Referring to FIGS. 8 and 9, a fixing device 5 according to a second illustrative embodiment will be described. An explanation will be given mainly for the parts different from the first illustrative embodiment, and an explanation will be omitted for the common parts by assigning the same reference numerals thereto.

In the first illustrative embodiment, the third shaft 35 is rotatably supported by the first sidewall 41 and the second sidewall 42.

In the second illustrative embodiment, as depicted in FIGS. 8 and 9, a third shaft 103 is integrally connected with a first pressing member 33L and a second pressing member 33R.

More specifically, for example, as depicted in FIG. 9, the first pressing member 33L further includes a first supporting portion 101.

The first supporting portion 101 extends downward from a rest portion 96 of the first pressing member 33L. The first supporting portion 101 has a plate-like shape extending in the up-down direction.

The second pressing member 33R further includes a second supporting portion 102.

The second supporting portion 102 extends downward from a rest portion 96 of the second pressing member 33R. The second supporting portion 102 has a plate-like shape extending in the up-down direction.

In the second illustrative embodiment, the fixing device 5 includes the third shaft 103 instead of the third shaft 35 of the first illustrative embodiment.

The third shaft 103 has a substantially rectangular rod-like shape extending in the right-left direction. The third shaft 103 includes a left end contiguous to a right surface of the first supporting portion 101, and a right end contiguous to a left surface of the second supporting portion 102. That is, the third shaft 103 is supported by a rear end portion of the first pressing member 33L and a rear end portion of the second pressing member 33R via the first supporting portion 101 and the second supporting portion 102, respectively.

As depicted in FIG. 8, in the fixing device 5, the third shaft 103 extends in the right-left direction through upper rear portions of the first sidewall 41 and the second sidewall 42.

The third shaft 103, the second shaft 32 (refer to FIG. 7), the first pressing member 33L, and the second pressing member 33R constitute a rectangular frame-shaped unit. Such a unit is in engagement with the upper end portions of the first sidewall 41 and the second sidewall 42.

According to the fixing device 5 of the second illustrative embodiment, the same effects obtained by the first illustrative embodiment may be obtained.

According to the fixing device 5 of the second illustrative embodiment, as depicted in FIG. 9, the third shaft 103 is supported by the rear end portion of the first pressing member 33L and the rear end portion of the second pressing member 33R via the first supporting portion 101 and the second supporting portion 102, respectively.

That is, the second shaft 32 (refer to FIG. 7) and the third shaft 103 are connected to each other via the first pressing member 33L and the second pressing member 33R.

Therefore, the frame 31 may be further reinforced.

The frame 31 may be reinforced with all of the second shaft 32 (refer to FIG. 7), the third shaft 103, the first pressing member 33L, and the second pressing member 33R.

Accordingly, the frame 31 may be further surely reinforced.

The third shaft 103, the second shaft 32 (refer to FIG. 7), the first pressing member 33L, and the second pressing member 33R constitute the rectangular frame-shaped unit. Such a unit is in engagement with the upper end portions of the first sidewall 41 and the second sidewall 42.

Therefore, the frame 31 may be further surely reinforced.

While the disclosure has been described in detail with reference to the specific embodiments thereof, these are merely examples, and various changes, arrangements and modifications may be applied therein without departing from the spirit and scope of the disclosure.

What is claimed is:

1. A fixing device comprising:

a heating unit including:

an endless belt extending in a longitudinal direction; and a heating plate disposed inside the endless belt and extending in the longitudinal direction;

a fixing roller configured to rotate about an axis extending in the longitudinal direction and configured to nip the endless belt with the heating plate to form a nip portion such that a sheet is conveyed through the nip portion in a conveying direction;

a frame supporting the heating unit and the fixing roller and including a first sidewall at one of end portions of the frame in the longitudinal direction and a second sidewall at the other of the end portions of the frame in the longitudinal direction;

a first shaft extending in the longitudinal direction, the fixing roller having the first shaft;

a second shaft extending in the longitudinal direction and disposed upstream of the nip portion in the conveying direction and disposed on a heat unit side with respect to the nip portion; and a third shaft extending in the longitudinal direction and disposed downstream of the nip portion in the conveying direction and disposed on the heat unit side with respect to the nip portion, wherein one end portion of the first shaft, one end portion of the second shaft and one end portion of the third shaft are supported by the first sidewall, and the other end portion of the first shaft, the other end portion of the second shaft and the other end portion of the third shaft are supported by the second sidewall, and wherein, when viewed from the longitudinal direction, the nip portion is positioned in a triangle defined by imaginary lines connecting the first shaft, the second shaft, and the third shaft to each other.

2. The fixing device according to claim 1, wherein the heating unit is disposed between the first sidewall and the second sidewall, is made of metallic material, and further includes a stay supporting the heating plate, and wherein at least a portion of the stay is included in the triangle when viewed from the longitudinal direction.

3. The fixing device according to claim 1, further comprising a pressing member extending in the conveying direction and configured to press the heating unit toward the fixing roller, the pressing member including a first end portion and a second end portion opposite to the first end portion in the conveying direction, wherein the second shaft rotatably supports the first end portion.

4. The fixing device according to claim 3, further comprising:

an urging member urging the second end portion; and a cam disposed at an end portion of the third shaft in the longitudinal direction and configured to move between a pressing position, at which the cam presses the second end portion in a direction opposite to an urging direction of the urging member, and a non-pressing position, at which the cam allows the second end portion to be free from pressure.

5. The fixing device according to claim 4, wherein the urging member is an extension coil spring.

6. The fixing device according to claim 3, wherein the third shaft is supported by the second end portion of the pressing member.

7. The fixing device according to claim 3, wherein the third shaft is integrally connected with the pressing member.

8. The fixing device according to claim 3, wherein the third shaft has a substantially rectangular rod-like shape extending in the longitudinal direction.

9. The fixing device according to claim 3, wherein the heating unit is entirely disposed between the second shaft and the third shaft.

10. The fixing device according to claim 1, wherein the first shaft has a diameter that is greater than diameters of the second shaft and the third shaft.

11. The fixing device according to claim 1, wherein when viewed from the longitudinal direction, the center of gravity of the triangle overlaps the heating unit.

12. The fixing device according to claim 1, wherein the frame is made of resin material, and wherein the first shaft, the second shaft, and the third shaft are made of metallic material.

* * * * *